US006883960B2

(12) United States Patent
Reeder et al.

(10) Patent No.: US 6,883,960 B2
(45) Date of Patent: Apr. 26, 2005

(54) MIXING ARRANGEMENT FOR TANKS

(75) Inventors: Mark F. Reeder, Tipp City, OH (US); Julian B. Fasano, Englewood, OH (US); Gregory T. Benz, Clarksville, OH (US); Robert R. Corpstein, Kettering, OH (US)

(73) Assignee: Chemineer, Inc., Dayton, OH (US)

( * ) Notice: Subject to any disclaimer, the term of this patent is extended or adjusted under 35 U.S.C. 154(b) by 233 days.

(21) Appl. No.: 10/147,935

(22) Filed: May 17, 2002

(65) Prior Publication Data

US 2002/0172092 A1 Nov. 21, 2002

Related U.S. Application Data

(60) Provisional application No. 60/292,024, filed on May 18, 2001.

(51) Int. Cl.[7] ..... B01F 11/04

(52) U.S. Cl. ..... 366/243; 366/276

(58) Field of Search ..... 366/242, 243, 366/255, 276, 277, 278

(56) References Cited

U.S. PATENT DOCUMENTS

| | | | | | |
|---|---|---|---|---|---|
| 2,993 | A | * | 3/1843 | Lindley et al. | 366/276 |
| 44,216 | A | * | 9/1864 | Plamer | 366/276 |
| 454,750 | A | | 6/1891 | Linebarger | |
| 466,178 | A | | 12/1891 | Mitchell | |
| 541,658 | A | | 6/1895 | Crooke | 366/244 |
| 579,025 | A | * | 3/1897 | Strong | 366/276 |
| 699,521 | A | * | 5/1902 | Heinrichs | 366/276 |
| 1,001,949 | A | | 8/1911 | Hanna | |
| 1,045,896 | A | | 12/1912 | Schultz | |
| 1,548,614 | A | * | 8/1925 | Konigsberg | 366/243 |
| 1,995,998 | A | * | 3/1935 | Nefedov | 366/276 |
| 2,559,196 | A | * | 7/1951 | Medved | 366/243 |
| 2,584,202 | A | * | 2/1952 | Harp, Sr. | 366/242 |
| 2,797,071 | A | * | 6/1957 | Karlen | 366/276 |
| 3,417,972 | A | * | 12/1968 | Conway | 366/242 |
| 3,734,119 | A | | 5/1973 | Nudds | |
| 3,856,273 | A | | 12/1974 | Born | |
| 3,955,802 | A | * | 5/1976 | de Bruyne | 366/343 |
| 3,998,435 | A | * | 12/1976 | de Bruyne | 366/243 |

(Continued)

FOREIGN PATENT DOCUMENTS

| | | |
|---|---|---|
| DE | 19705118 | 8/1998 |
| EP | 0433694 | 6/1991 |

OTHER PUBLICATIONS

*RA–48 Series Reactors, Data Sheet DS81–100A–2*, Ofaudler, Inc. (Mar. 1998).

*RA–96 Series Reactors, Data Sheet DS81–100d–2*, Pfaudler, Inc. (Mar. 1998).

*RT–14–5/10, RT Series Reactors 10 Gallon, Data Sheet DS81–400A–1*, Pfaudler, Inc. (Jul. 1995).

(Continued)

*Primary Examiner*—Tony G. Soohoo

(74) *Attorney, Agent, or Firm*—Thompson Hine LLP

(57) ABSTRACT

In one aspect, a mixing arrangement is provided for a tank mixing system which includes a tank defined by a side wall, a bottom and a top, the top including at least one opening therethrough. The arrangement includes a non-rotating elongated arm extending through the opening in the top of the tank, the arm pivoted for movement about a pivot axis; an impeller positioned on the arm for movement therewith and within the tank, the impeller moving back and forth along an arcuate path within the tank as the arm pivots back and forth about the pivot axis. In another aspect, a ball-and-socket assembly is positioned above the top of the tank and is movable along a curved path to mope an impeller in a curved path within the tank.

37 Claims, 11 Drawing Sheets

U.S. PATENT DOCUMENTS

| | | | | | |
|---|---|---|---|---|---|
| RE30,237 | E | | 3/1980 | Born | |
| 4,204,774 | A | * | 5/1980 | de Bruyne | 366/242 |
| 4,606,103 | A | * | 8/1986 | Koehl et al. | 366/247 |
| 4,721,392 | A | | 1/1988 | Fries et al. | |
| 5,374,121 | A | * | 12/1994 | Draenert | 366/242 |
| 5,476,321 | A | | 12/1995 | McNaughton | |
| 5,582,799 | A | | 12/1996 | Amorese et al. | |
| 6,270,249 | B1 | | 8/2001 | Besuner et al. | |

OTHER PUBLICATIONS

*RT–48–300/500, RT Series Reactors 300/500 Gallon, Data Sheet DS81–400F–1*, Pfaudler, Inc. (Jul. 1995).

*Lightnin MagMixer™ MBI, New Hyper–Flo bearing design proven more cleanable than conventional designs*, Lightnin (Sep. 1999).

* cited by examiner

MIXING ARRANGEMENT FOR TANKS

CROSS REFERENCE TO RELATED APPLICATION

This patent application claims priority to provisional patent application Ser. No. 60/292,024 filed May 18, 2001.

TECHNICAL FIELD

The present application relates to mixing arrangements, and more particularly to mixing arrangements for use in tank systems.

BACKGROUND

The most commonly utilized tank mixing systems utilize a shaft that extends below the liquid level of the tank and has an impeller attached thereto. The shaft and impeller combination is rotated to generate flow within the tank. In the case of cylindrical mixing tanks, baffles are often times necessary along the side wall of the tank in order to generate a desired top to bottom flow. While such mixing systems are generally accepted, they can create problems in certain mixing environments.

For example, in "clean" type mixing environments such as those commonly used in the pharmaceutical industry, it is required that the contents of the mixing tank be fully enclosed and sealed from the environment. Achieving this result with a rotating shaft and impeller arrangement can prove extremely difficult. Attempts have been made to utilize magnetic driving systems in order to eliminate the need for rotating seals, but these systems are expensive and difficult to maintain and clean. Further, the baffles often required by rotational type impellers make tank cleaning more difficult and expensive.

Accordingly, it would be desirable to provide a mixing arrangement, which is more readily suited for use in both open, and closed-tank mixing systems.

SUMMARY

In one aspect, a mixing arrangement is provided for a closed-tank mixing system including a tank defined by a side wall, a bottom and a top, the top including at least one opening therethrough. The mixing arrangement includes: a non-rotating elongated arm extending through the opening in the top of the tank, the arm pivoted for movement about a pivot axis; and an impeller positioned on the arm for movement therewith and within the tank, the impeller moving back and forth along an arcuate path within the tank as the arm pivots back and forth about the pivot axis.

In another aspect, a mixing arrangement is provided for a closed-tank mixing system including a tank defined by a side wall, a bottom and a top, the tank including at least one opening therethrough. The mixing arrangement includes: a non-rotating elongated arm extending through the opening in the tank, the arm pivoted for movement about a pivot axis; and an impeller positioned on the arm for movement therewith and within the tank, the impeller moving back and forth along an arcuate path within the tank as the arm pivots back and forth about the pivot axis.

In another aspect, a mixing arrangement includes a tank having a side wall, a bottom and a top, the top including at least one opening therethrough, the arrangement comprising: a non-rotating elongated arm extending through the opening in the top of the tank, the arm pivoted for movement about a pivot axis; an impeller positioned on the arm for movement therewith and within the tank, the impeller moving back and forth along an arcuate path within the tank as the arm pivots back and forth about the pivot axis; and wherein the impeller is configured to create a net circular flow within the tank.

In another aspect, a mixing arrangement is provided for a mixing system including a tank having a side wall, a bottom and a top, the top including at least one opening therethrough. The mixing arrangement includes: a ball-and-socket assembly positioned above the top of the tank and movable along a curved path; an elongated arm extending through the opening in the top of the tank, the elongated arm connected to the ball-and-socket assembly; a support positioned along the elongated arm between the pivot axis and the opening for maintaining the elongated arm in a non-vertical, inclined orientation during movement of the ball-and-socket type assembly in the curved path; and an impeller positioned on the arm for movement therewith and within the tank, the impeller moving in a curved path within the tank as the ball-and-socket type assembly moves along its curved path.

In another aspect, a mixing method for a tank system involves providing a non-rotating elongated arm extending within the tank through a tank opening; providing an impeller on the elongated arm and within the tank; providing a sealing arrangement about the tank opening and elongated arm; moving the elongated arm back and forth to move the impeller back and forth through an arcuate path within the tank.

In another aspect a mixing method for a tank system involves providing an elongated arm extending within the tank through a tank opening; providing an exterior connection point for the elongated arm, the exterior connection point movable in a continuous and curved path; providing a ball-and-socket type connection between an exterior end of the elongated arm and the exterior connection point; supporting the elongated arm at a support location between the exterior connection point and the tank opening; providing an impeller on the elongated arm and within the tank; rotating the exterior connection point repeatedly through its continuous and curved path while maintaining the support location of the elongated arm at a substantially fixed position to result in a repeating movement of the impeller through a curved path within the tank.

In another aspect a method for mixing pharmaceutical compositions in a closed tank system involves providing a non-rotating elongated arm extending within the tank through a tank opening; providing an impeller on the elongated arm and within the tank; providing a sealing arrangement about the tank opening and elongated arm; pivoting the elongated arm back and forth about a pivot to move the impeller back and forth through an arcuate path within the tank.

In another aspect a method for mixing pharmaceutical compositions in a closed tank system involves providing an elongated arm extending within the tank through a tank opening; providing an exterior connection point for the elongated arm, the exterior connection point movable in a continuous and curved path; providing a ball-and-socket type connection between an exterior end of the elongated arm and the exterior connection point; supporting the elongated arm at a support location between the exterior connection point and the tank opening; providing an impeller on the elongated arm and within the tank; rotating the exterior connection point repeatedly through its continuous and curved path while maintaining the support location of the elongated arm at a substantially fixed position to result in a repeating movement of the impeller through a curved path within the tank.

In another aspect a mixing assembly for mounting to a tank is provided, the assembly including a mounting plate for mounting the assembly adjacent a tank opening, the mounting plate including an opening for alignment with the tank opening; a flexible seal positioned between the plate member and the mounting plate and including an opening therethrough aligned with the mounting plate opening; a non-rotating elongated arm including a first portion extending within the flexible seal and a second portion extending out of the flexible seal and through the mounting plate opening; an impeller connected to the second portion of the elongated arm; a motor operatively connected for moving the first portion of the elongated arm back and forth; wherein the impeller is moved back and forth along an arcuate path as the first portion of the elongated arm is moved back and forth.

Where pharmaceutical compositions are to be mixed, or in other cases, the tank, arm and impeller may be glass lined.

Other variations on a mixing method and arrangement in which an impeller is moved within a tank through a sweeping type motion are also possible. Each of the mixing arrangements may be used in combination with cylindrical tanks which are baffle-free. Use with non-cylindrical tanks is also contemplated. Further use of the mixing arrangement in continuous flow tanks having an inlet and outlet through which materials flow during mixing is contemplated.

As used herein the term "flexible seal" is intended to broadly encompass members comprised completely of flexible material and members comprised only partially of flexible material. As used herein the term "elongated arm" is intended to broadly encompass unitary arm members, multi-piece arm members, straight shaft type arm members and non-straight arm members.

DETAILED DESCRIPTION

Figure 1B:
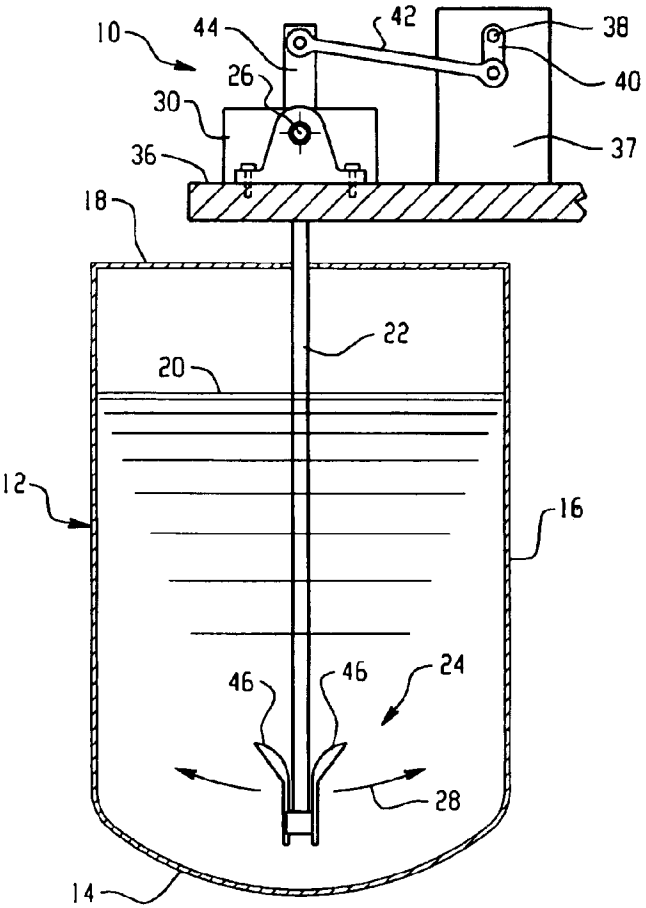
FIGS. 1A and 1B are front and side elevations of an exemplary mixing arrangement.
Figure 1A:
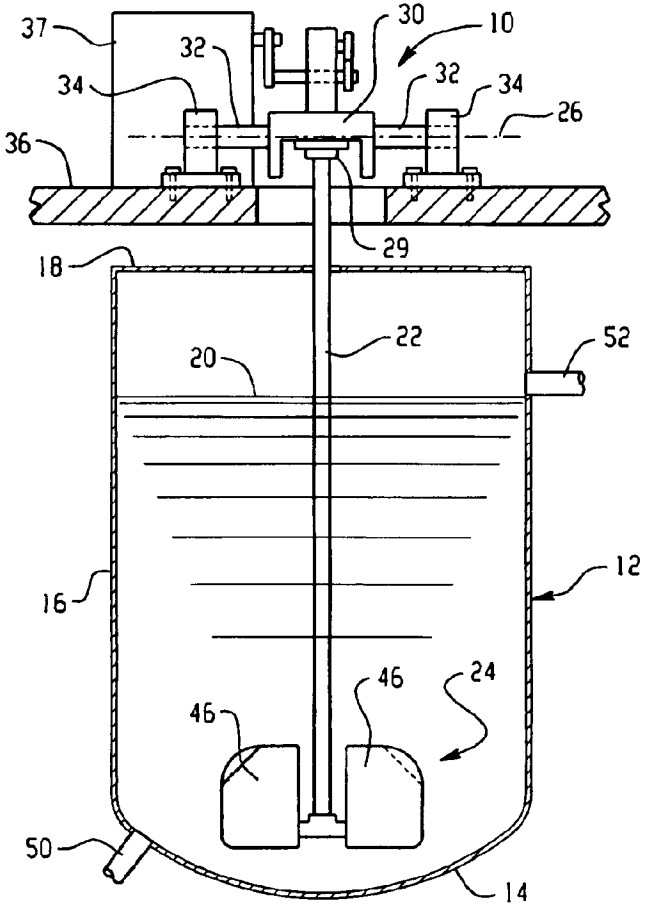

Referring to the drawings, a schematic diagram of a mixing arrangement 10 for a tank 12 is shown in the front and side elevations of FIGS. 1A and 1B. The tank 12 includes a bottom wall 14, side wall 16 and top portion 18. The bottom wall 14 may be curved, the side wall 14 may be cylindrical in shape, and the top 18 may be fully open or partially closed with an opening therethrough. A liquid level within the tank 12 is shown at 20. A non-rotating elongated arm 22 extends into the tank and includes an impeller 24 connected thereto and positioned within the tank. The elongated arm 22 may take the form of a straight shaft, but could take other forms as well. The arm 22 is connected for movement about a pivot axis 26. In a mixing operation the arm 22 is pivoted back and forth about the pivot axis 26 in order to move the impeller 24 back and forth along an arcuate path 28 within the tank to generate flow within the tank. Suitable mixing can be achieved with the speed of pivot of the shaft and impeller less than 350 cycles/min and movement of the impeller through at least thirty percent of the tank diameter. Of course, variations outside these ranges are possible and contemplated. The location of the arcuate path within the tank may be fixed during normal mixing operations. However, it is recognized that the position of the impeller on the arm 22 may be adjustable for varying the location of the arcuate path.

In the illustrated embodiment the pivot axis is located above the top opening of the tank 12. In particular, the arm 22 is connected by a coupler 29 to a support in the form of a plate member 30 which is supported above the tank for pivoting about the pivot axis 26. While the use of a support in the form of a plate member is primarily described, other support configurations are contemplated. The plate member includes sides which are shaped for mounting on respective side shafts 32. The side shafts 32 are supported by brackets/braces 34 which are mounted to a platform 36. A single shaft extending between brackets 34 could also be used. The plate member 30 may rotate relative to the shafts 32 via a bearing connection between the two. Alternatively, the plate member 30 may be rigidly connected to the shafts 32, with the shafts rotatable relative to the brackets 34 via a bearing connection. In either case, the plate 30 can be pivoted back and forth around the pivot axis to cause the arm 22 and impeller 24 to move as desired. The arm 22 could alternatively extend through an opening in the plate 30, with appropriate sealing provided. In the illustrated embodiment the top of the plate member 30 is connected via a linkage system for movement by a motor assembly 37. The rotating output shaft of 38 of the motor assembly 37 connects to a linkage 40 for rotating the linkage 40. Linkage 40 is pivotably connected to linkage 42, which in turn is pivotably connected to linkage 44, which in turn is rigidly connected to the plate 30. It is recognized that the extent of movement of the impeller 24 along the arcuate path may be adjusted from mixing operation to mixing operation by providing an adjustable drive mechanism for controlling the amount of pivoting movement of the arm 22.

Moving the impeller back and forth through an arcuate path within the tank 12 can produce a net circular flow within the tank about a tank axis that is normal to the opening through which the arm 22 extends. In the case of the illustrated embodiments of FIGS. 1–9 such a tank axis would be vertical while in the illustrated embodiments of FIGS. 10–13 such a tank axis would be horizontal. A top to bottom to top flow (FIGS. 1–9) within the tank can also be generated by the arcuate movement of the impeller. Production of the net circular flow may be facilitated via appropriate construction of the impeller. In the illustrated embodiment the impeller 24 includes diametrically opposed blades 46. One blade is shaped such that the flow it produces when moved in a first direction along path 28 is greater than the flow it produces when moved in a second, opposite direction along the path. The other blade is shaped such that the flow it produces when moved in the first direction along path 28 is less than the flow it produces when moved in the second, opposite direction along the path. For example bends placed appropriately on each blade may provide a concave portion on one side of each blade and a convex portion on the other side of each blade.

The embodiment of FIGS. 1A and 1B could be used with a tank having an inlet and an outlet for continuous stirred tank reactor applications. For example, an inlet 50 could be located at a lower portion of the tank 12 and an overflow outlet 52 could be located at an upper portion of the tank 12. Multiple inlets and outlets could be provided. It is recognized that tanks with inlet(s) and outlet(s) could also be used in connection with the arrangements to be described below.

Figure 2:
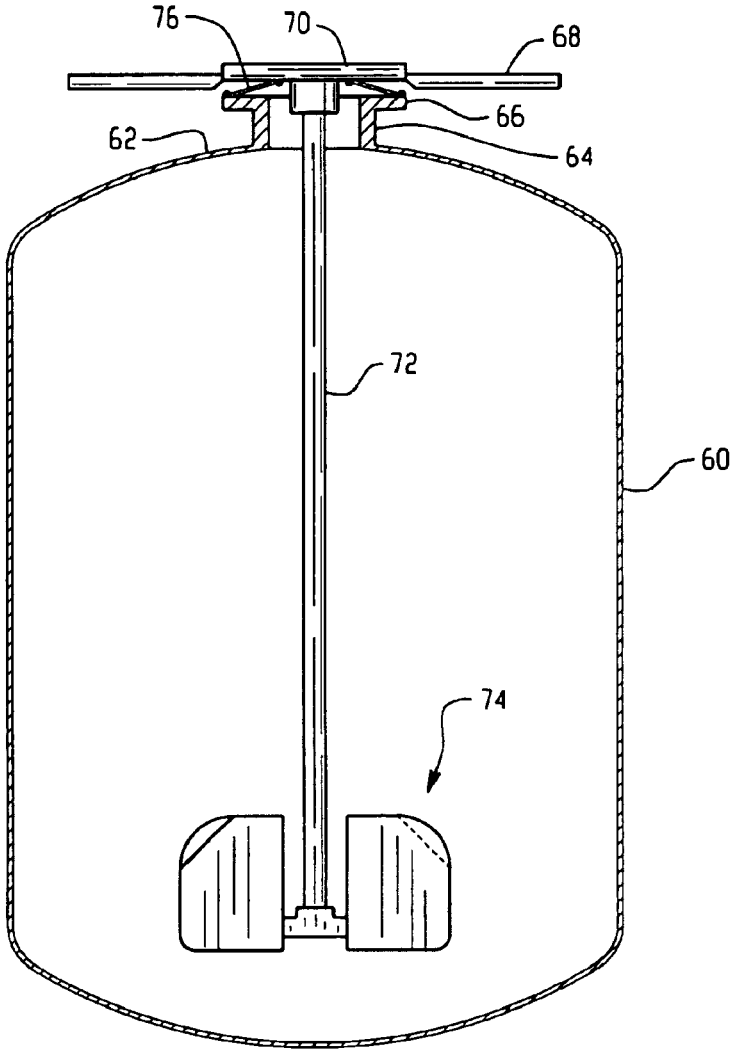
FIG. 2 is another exemplary mixing arrangement.
Figure 3:
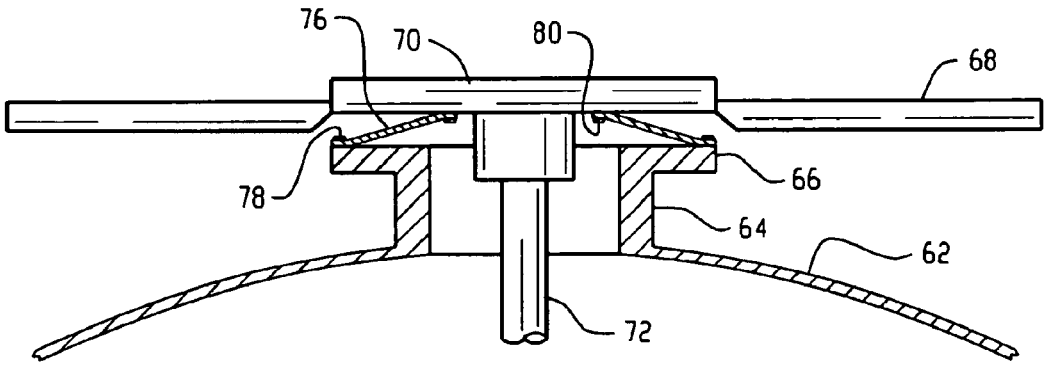
FIG. 3 is an enlarged view of the upper portion of FIG. 2.

Another embodiment is partially shown in the front views FIGS. 2 and 3 where a tank 60 includes a top portion 62 which is generally covered and has an opening therethrough via a protruding neck 64 having a flange 66 thereabout. The pivoting shaft 68 and associated plate 70 are shown, with arm 72 extending from the underside of the plate 70 into the tank and impeller 74 connected to the arm 72. A flexible membrane type seal 76 (shown in cross-section only) is connected around the arm 72 and between the plate 70 and the tank in order to fully enclose the contents of the tank in order to provide a closed-tank mixing system. Support rings 78 and 80 may be used to attach the membrane 76 to the flange 66 and plate 70 respectively. The membrane can be made of any material of suitable strength to facilitate movement of the plate member 70 while still maintaining a sealing arrangement. By way of example, and not by way of limitation, the membrane may be any one of a polytetrafluoroethylene (PTFE), a fluoroelastomer material, a perfluoroelastomer material, a stainless steel material, an elastomeric material, a nickel alloy material, or combinations of the same. Notably, because the shaft and impeller are not rotated in the illustrated mixing system, there is no moving interface which needs to be sealed.

Figure 4:
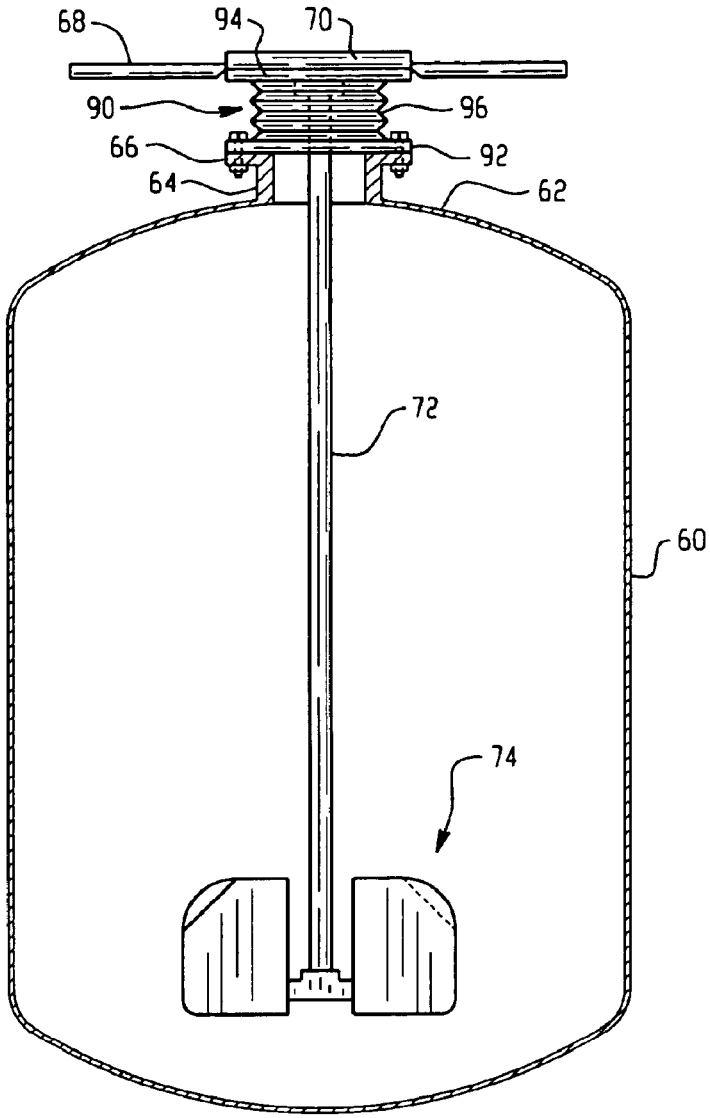
FIG. 4 is another exemplary mixing arrangement.
Figure 5:
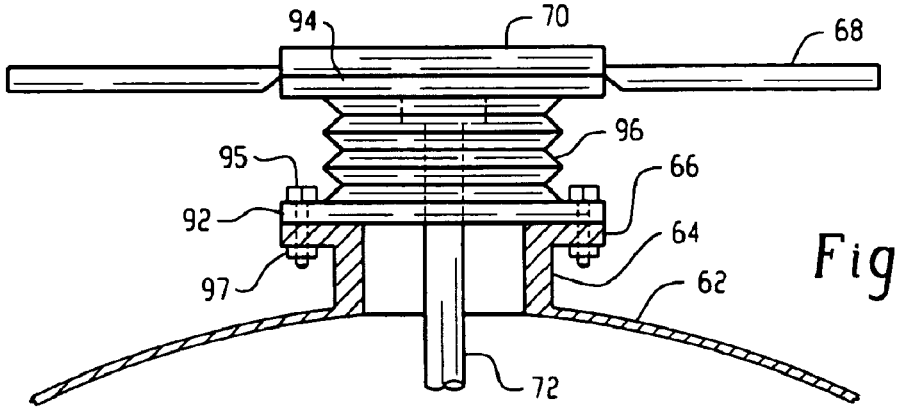
FIG. 5 is an enlarged view of the upper portion of FIG. 4.

FIGS. 4 and 5 illustrate a front view of another embodiment in which a flexible seal in the form of a bellows assembly 90 is utilized. In the illustrated embodiment the bellows assembly is formed by an annular lower plate 92 which is fixed to the upper surface of the flange 66, an annular upper plate 94 which is fixed to the underside of plate 70, and a bellows membrane 96 which extends between the two plates 92 and 94. Gaskets or O-rings may be positioned between plate 92 and flange 66 and plate 94 and plate 70. The ends of the bellows membrane 96 may also be positioned between plate 92 and flange 66 and plate 94 and plate 70 in order to securely hold the membrane in place. A plurality of bolt 95 and nut 97 assemblies may be used to secure the plate 92 to the flange 66. Similar bolt and nut assemblies may attach the plate 94 to plate 70. Of course, other attachment systems could be used. Annular support rings may also be provided about the bellows membrane to prevent rupture of the membrane under pressurized situations.

Figure 6:
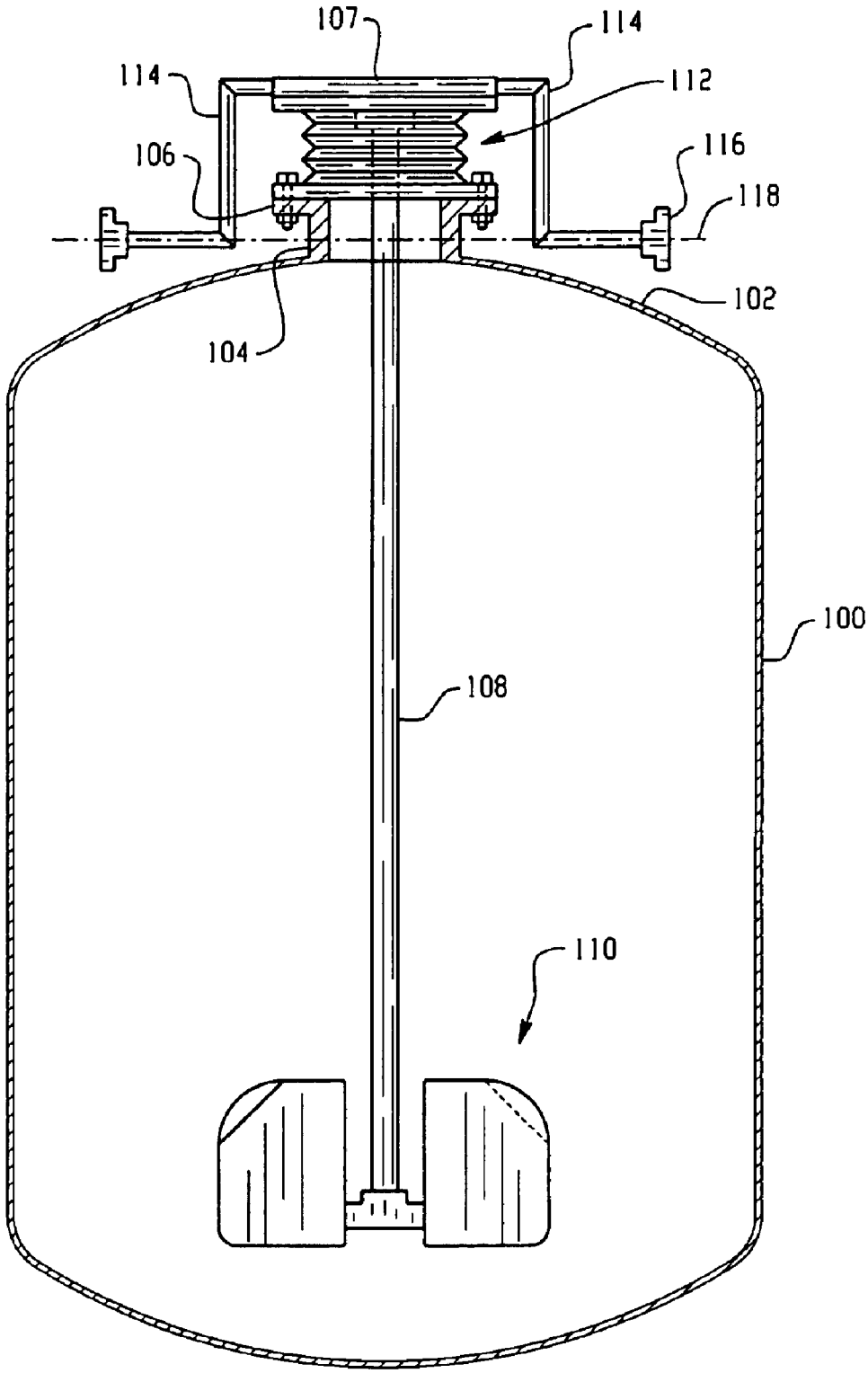
FIG. 6 is another exemplary mixing arrangement.

FIG. 6 schematically illustrates an embodiment in which the pivot axis is located below the tank opening. In particular, tank 100 includes a top portion 102 with a neck 104 and flange 106 defining an opening. A plate 107 is positioned above the opening and arm 108 extends from the underside of the plate into the tank 100 for moving impeller 110 back and forth. Bellows assembly 112 is provided for fully enclosing the tank. Side shafts 114 extend from the plate 107 and are pivotably mounted to supports 116 to define a pivot axis 118 for the arm 108, where the pivot axis extends through the tank at a location below the opening in the tank. Where the arm 108 is straight, the pivot axis may intersect the arm 108 when the arm is vertically oriented.

Figure 7:
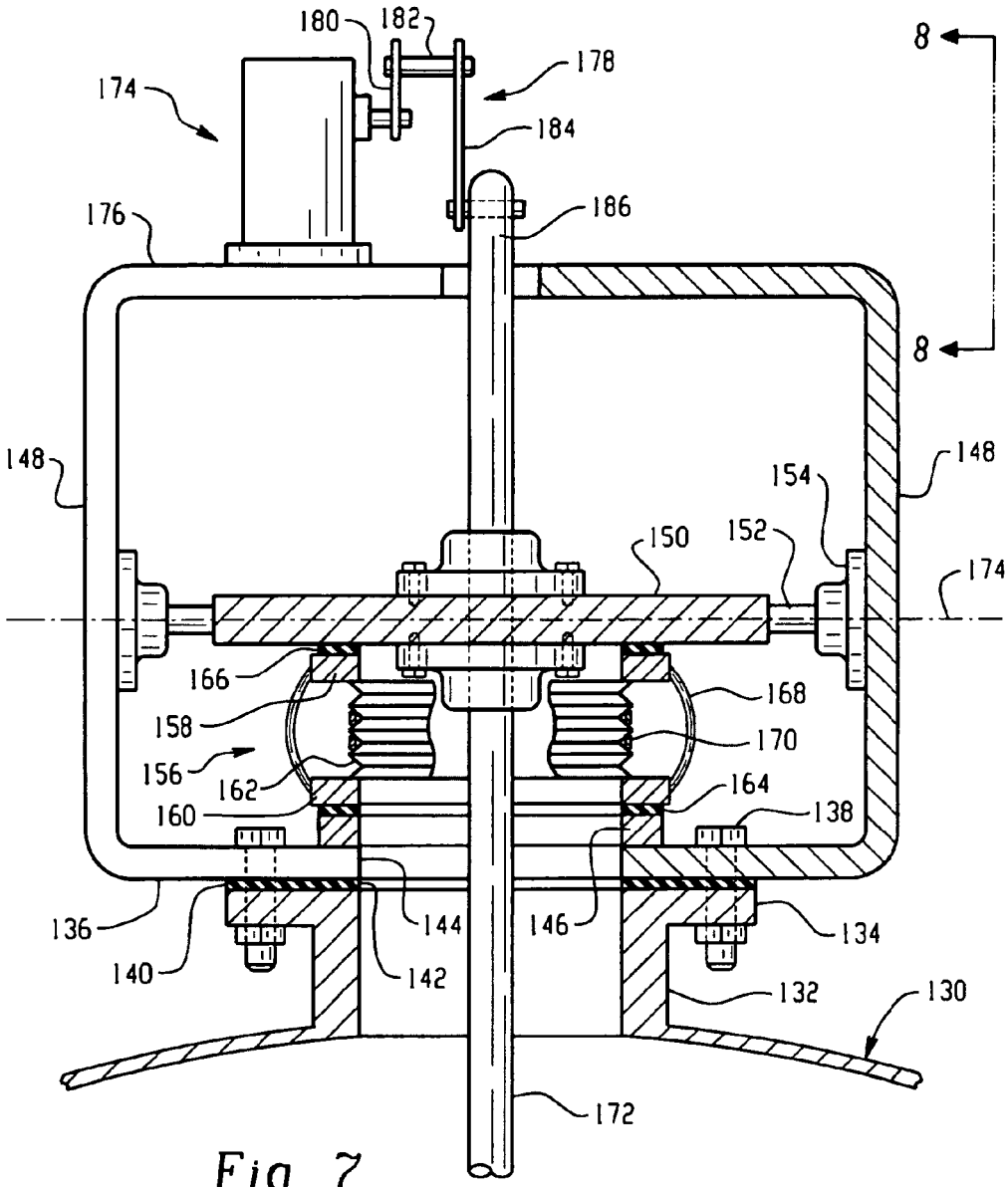
FIG. 7 illustrates the upper portion of another exemplary mixing arrangement.
Figure 8:
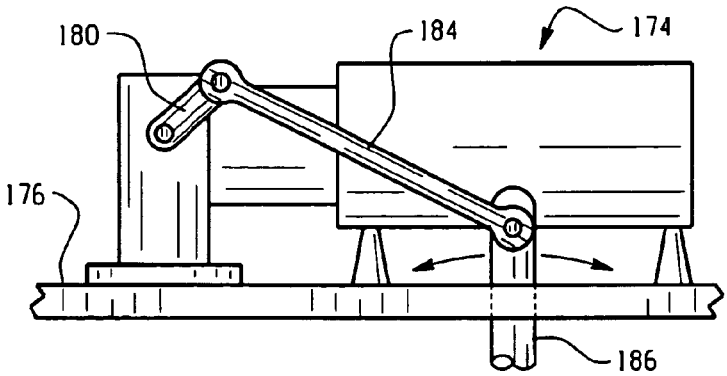
FIG. 8 is a side elevation along line 8—8 of FIG. 7.

A mixing arrangement suited for mounting on a mixing tank is shown in FIG. 7 where the tank 130 includes a neck 132 and flange 134. The arrangement includes a mounting plate 136 for mounting to the tank flange 134 via a plurality of bolts 138. A gasket 140 is provided between the mounting plate and the flange 134 for sealing purposes. Both the gasket 140 and mounting plate 136 include openings 142 and 144 which align with the tank opening defined by the flange 134 and neck 132. A flange 146 extends from the mounting plate 136 and is positioned about the mounting plate opening. The flange 146 may be unitary with the mounting plate or attached thereto such as by welding. A support wall 148 extends upward from the mounting plate and may be unitary therewith or connected thereto. Wall 148 is shown on the left and right sides, but it is possible a single wall might be provided. Plate member 150 is pivotably connected to the support wall and is spaced from the flange 146. The pivotable connection of the plate member 150 may be provided by side shafts 152 and support bracket 154 connected to wall 148. A bellows assembly 156 is connected between the plate member 150 and the flange 146. The bellows assembly may include upper and lower annular rings 158 and 160 with bellows membrane 162 extending therebetween. The upper and lower rings 158 and 160 may be connected to the plate member 150 and flange 146 respectively using bolts or other fastening means such as screws or clamps. Gaskets 164 and 166 may be provided for sealing purposes. Bellows assembly 156 may also include a plurality of metallic, flexible rope-type members 168 extending between the rings 158 and 160 for limiting the relative movement between the two rings 158 and 160, as wells as one or more annular bands 170 surrounding the bellows membrane for support. The flange 146 could be eliminated and the bellows assembly connected directly to the mounting plate with a gasket therebetween.

An elongated arm 172 is connected to the portion of the plate member 150 which is enclosed by the bellows assembly and extends into the tank 130. An impeller (not shown) is connected to the arm 172 within the tank. The arm is moved back and forth about a pivot axis in order to move the impeller within the tank back and forth through an arcuate path. In this regard, a drive including a motor assembly 174 mounted to a top support wall 176 is provided with a linkage system 178 extending to the plate member 150. The linkage system may include link 180 connected for rotation with the rotating output shaft of the motor assembly. The link 180 connects to a link 184 via a pin or shaft 182. Link 184 connects to a shaft 186 which extends down and connects to plate member 150. Of course, other drive arrangements could be provided, including pneumatic, hydraulic etc.

Figure 9:
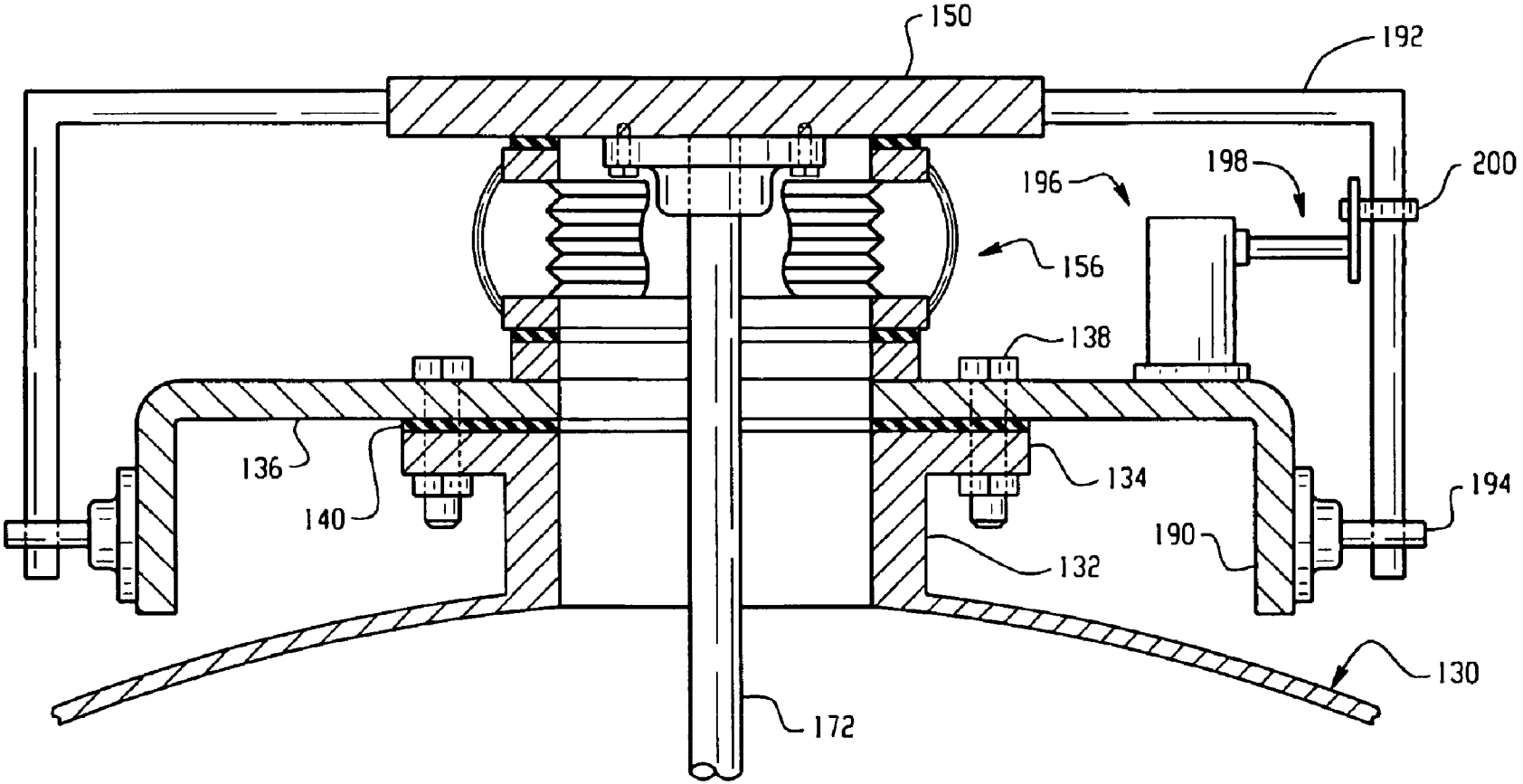
FIG. 9 illustrates the top portion of another exemplary mixing arrangement.

Another embodiment is shown in FIG. 9 and includes many similar components to that of FIG. 7, with alterations made to place the pivot axis below the opening in the mounting plate. In particular, a support wall 190 extends downward from the mounting plate 136 and side shafts 192 extend horizontally and then downward for connection to pivots 194 on the wall 190. A drive including a motor assembly 196 and linkage system 198 may push the shaft back and forth, with the linkage including a sliding collar 200 about the vertically extending portion of the shaft 192. The drive could also be associated with the horizontal portion of shaft 192 or with the plate 150 as in the embodiment of FIG. 7.

Figure 11:
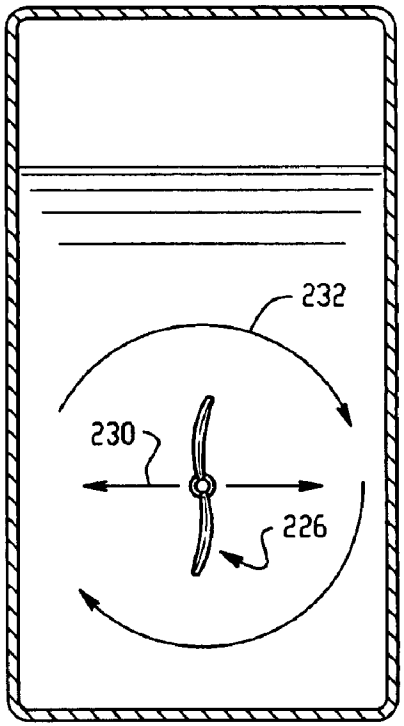
FIG. 11 is a side elevation along line 11—11 of FIG. 10.
Figure 10:
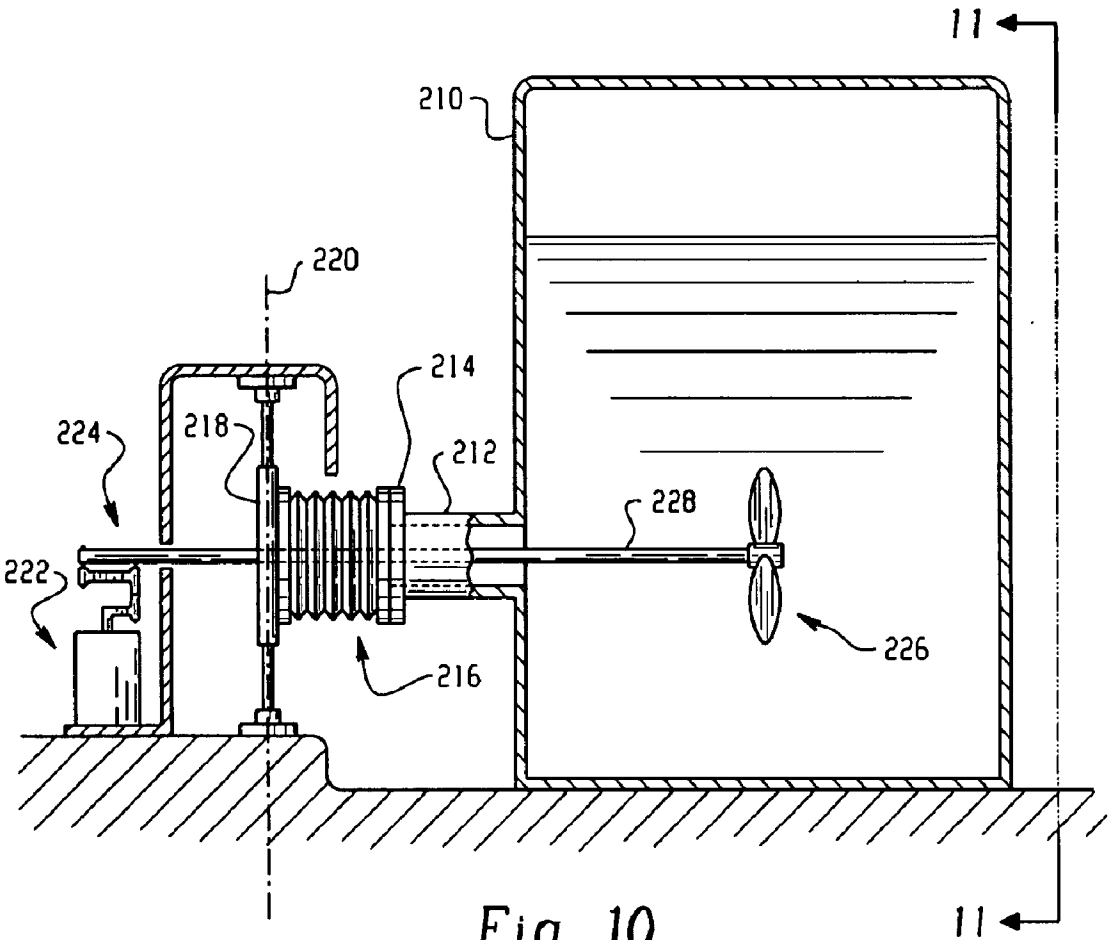
FIG. 10 illustrates an exemplary laterally oriented mixing arrangement.
Figure 13:
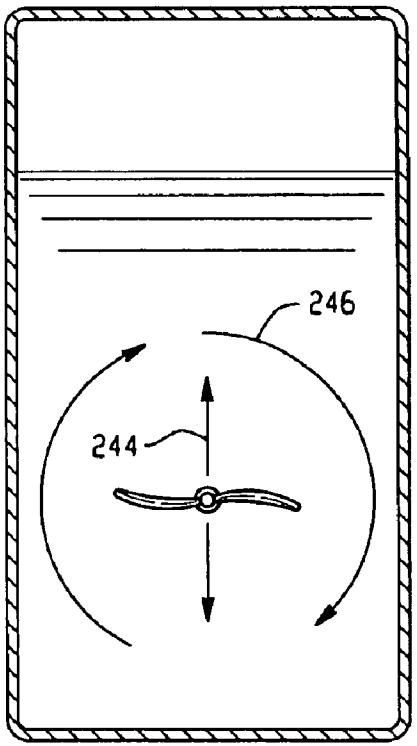
FIG. 13 is a side elevation along lines 13—13 of FIG. 12.
Figure 12:
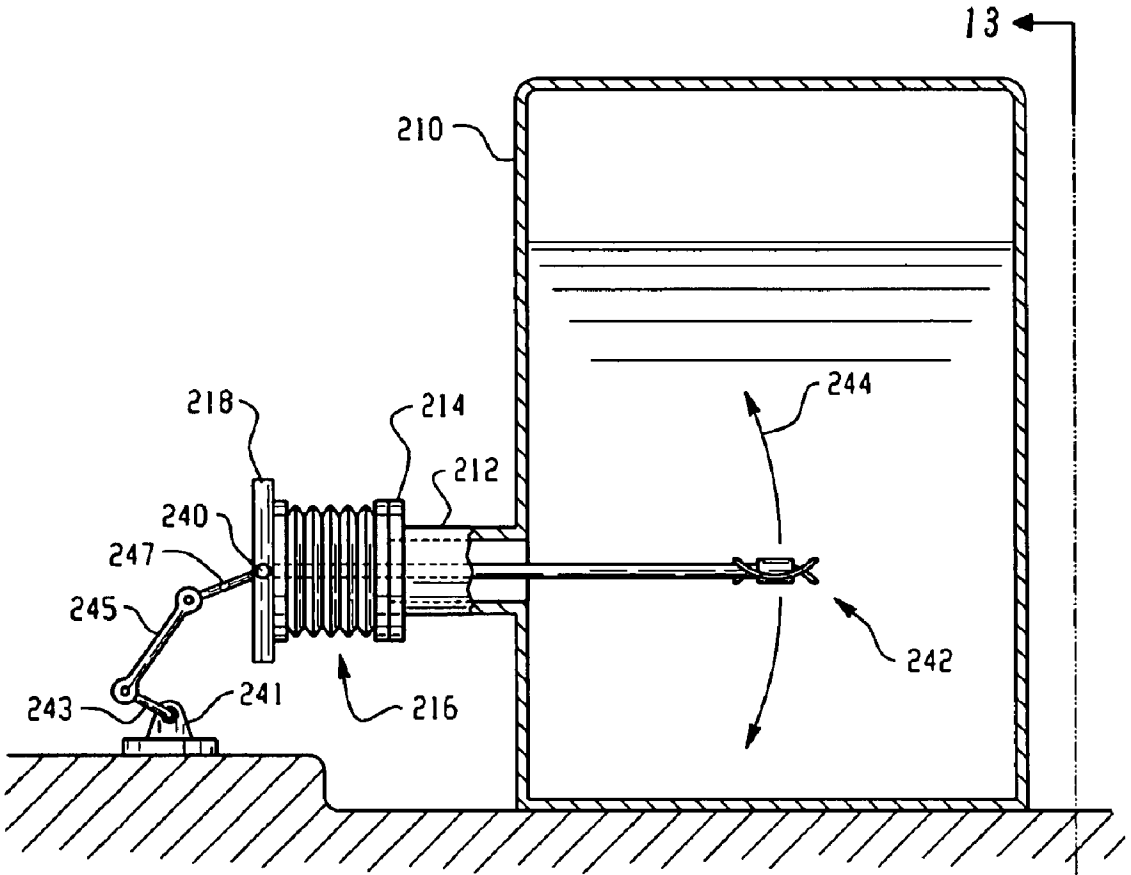
FIG. 12 illustrates another exemplary laterally oriented mixing arrangement.

While the foregoing embodiments contemplate mixing arrangements for tanks including top side openings, side mount arrangements may also be provided. One embodiment of such an arrangement is shown in FIGS. 10 and 11 and utilizes many similar components to the above embodiments. Tank 210 includes a sidewardly extending neck 212 and associate flange 214, a bellows assembly 216 between the flange and a plate member 218, with the plate member pivoted for movement about axis 220. A motor assembly 222 and drive linkage 224 are also provided. The impeller 226 on arm 228 is moved back and forth through a path into and out of the page in the view of FIG. 10 and left to right as shown by arrows 230 in the side view of FIG. 11. The resulting net circular flow 232 is also shown in FIG. 11. Referring to FIG. 12, a similar arrangement in which the pivot point 240 is defined into the page results in movement of the impeller 242 up and down along path 244. The support for achieving this pivot axis is not shown but could be essentially the same as for other configurations. Net circular flow 246 is shown in the side view of FIG. 13.

Figure 14:
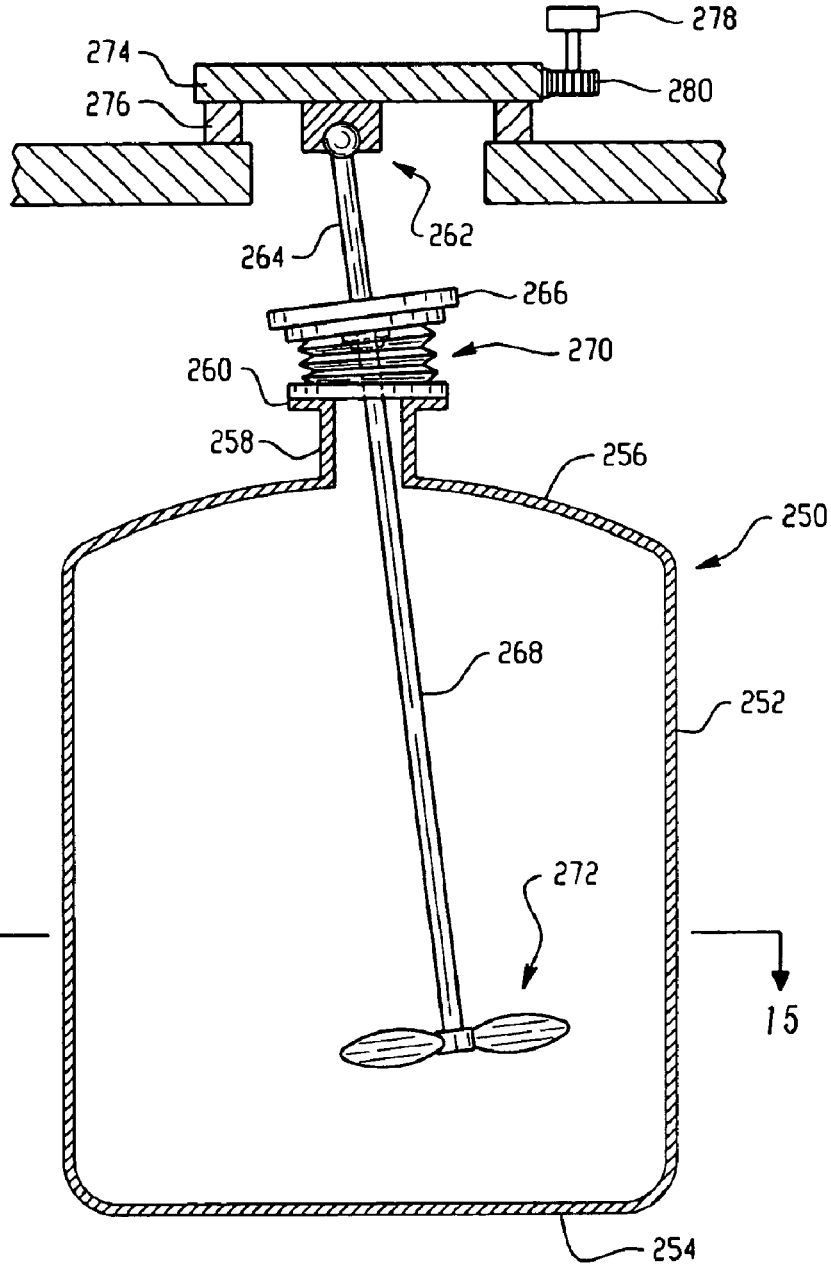
FIG. 14 illustrates an exemplary mixing arrangement with a nutating impeller shaft.
Figure 15:
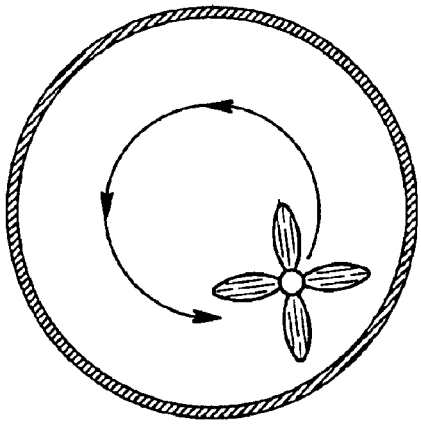
FIG. 15 is a top view along line 15—15 of FIG. 14.

An arrangement providing nutation of an impeller is illustrated in FIGS. 14 and 15. A tank 250 is defined by a side wall 252, a bottom 254 and a top 256, the top including at least one opening therethrough which may be formed by neck 258 and flange 260. The mixing arrangement includes a ball-and-socket assembly 262 positioned above the top of the tank and movable along a substantially circular path having a center point which is concentric with a center point of the tank opening. A shaft 264 extends to a plate 266 and a shaft 268 extends from the plate 266 into the tank. A bellows assembly 270 is provided between the flange 260 and the plate 266. The bellows assembly acts as a support positioned along the elongated arm formed by shaft 264, plate 266 and shaft 268. The elongated arm is thus maintained in a non-vertical, inclined orientation during movement of the ball-and-socket type assembly in the circular path. Additional support structure could also be provided around the outer surface of the plate 266 or about the shaft 264. An impeller 272 is positioned on the arm for movement therewith and within the tank, the impeller moving in a substantially circular path within the tank as the ball-and-socket type assembly moves along its substantially circular path. The ball-and-socket type assembly may be mounted to a rotating plate 274 which may be formed by a gear member. The plate 274 may be supported for rotation on a turntable 276. A motor 278 and spur gear 280 combination may be used to rotate the plate. The circular path of the impeller 272 within the tank is shown in the top view of FIG. 15. Other drive arrangements for moving the ball-and-socket type assembly through its circular path could provided, and it is contemplated that some arrangements may be provided to move the ball-and-socket type assembly in a non-circular curved path. As used herein the term ball-and-socket type assembly is intended to broadly encompass shaft support structure which allows rotation between the shaft 264 and the support structure during movement. For example, the shaft 264 could be formed with an enlarged upper head portion and the ball-and-socket assembly could be formed by a tubular member surrounding a portion of the shaft just below the head and on which the head rests, with the tubular member connected for rotation with the plate 274.

Figure 16:
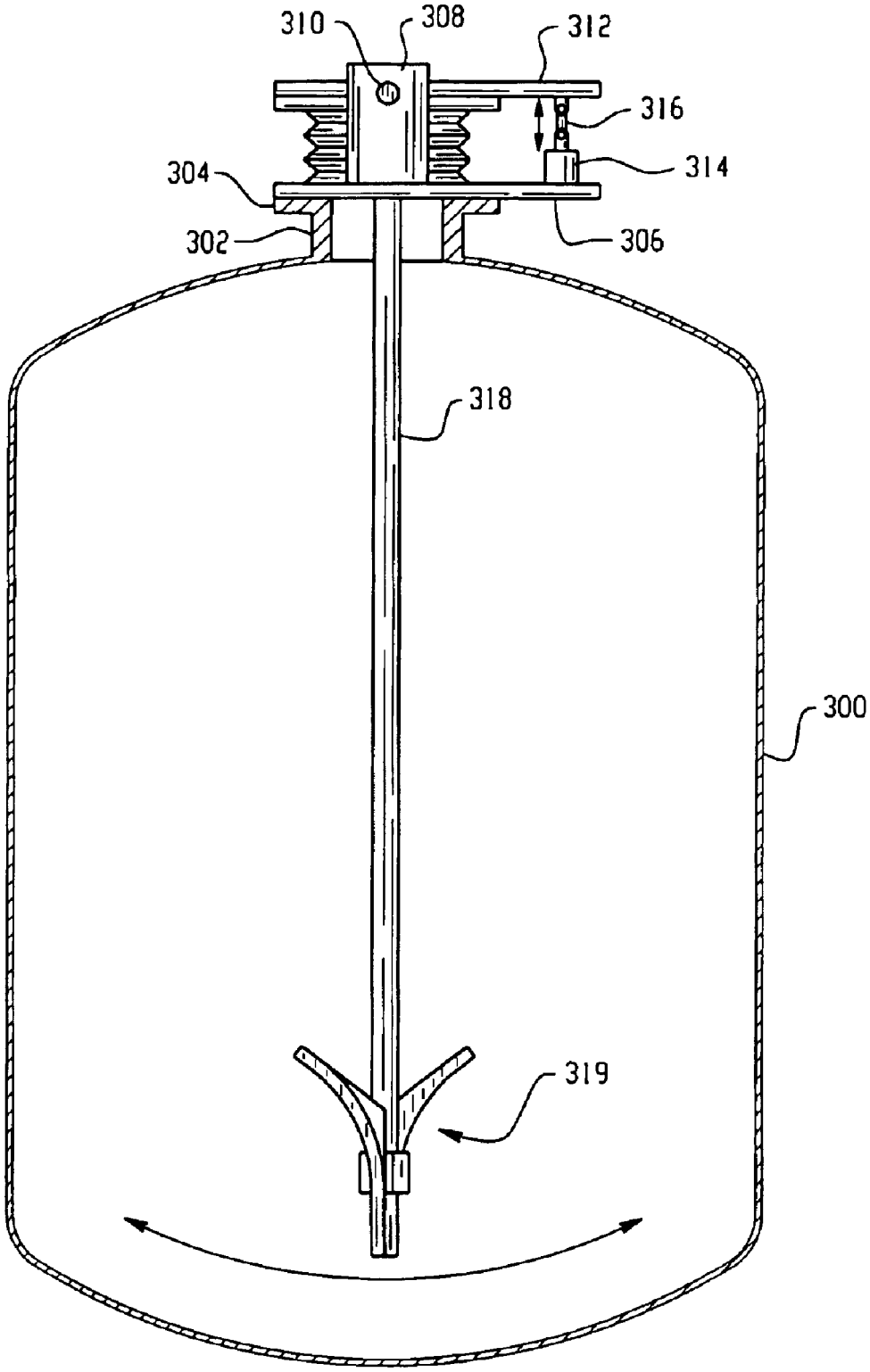
FIG. 16 is another exemplary mixing arrangement.
Figure 17:
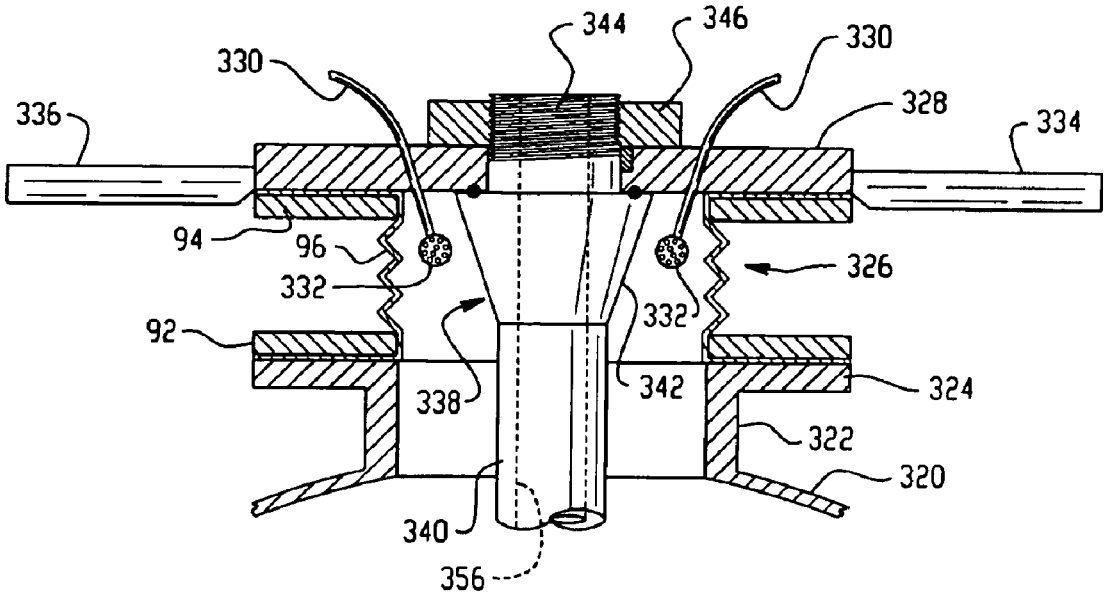
FIG. 17 illustrates the top portion of an exemplary mixing arrangement including internal spray balls and a mixing shaft with an internal passage.

Referring to FIG. 16, an embodiment illustrating use of a linear motor is shown and includes a tank 300 with a neck 302 and flange 304. A plate 306 is attached to the flange 304 and an o-ring may be positioned between the flange 304 and plate 306. A pillow block bearing 308 extends upward from the plate 306 and a pivot shaft 310 is pivotably mounted to the block. The pivot shaft 310 connects to an upper plate 312. A linear motor 314 is also positioned on the lower plate 306 and a linkage 308 extends between the motor 314 and the upper plate 312. The shaft 318 extends upward within the baffle assembly and connects to the upper plate 312. The linear motor 314 moves the linkage 316 up and down to pivot the upper plate 312 back and forth causing the impeller 319 to move back and forth along an arcuate path.

Figure 18:
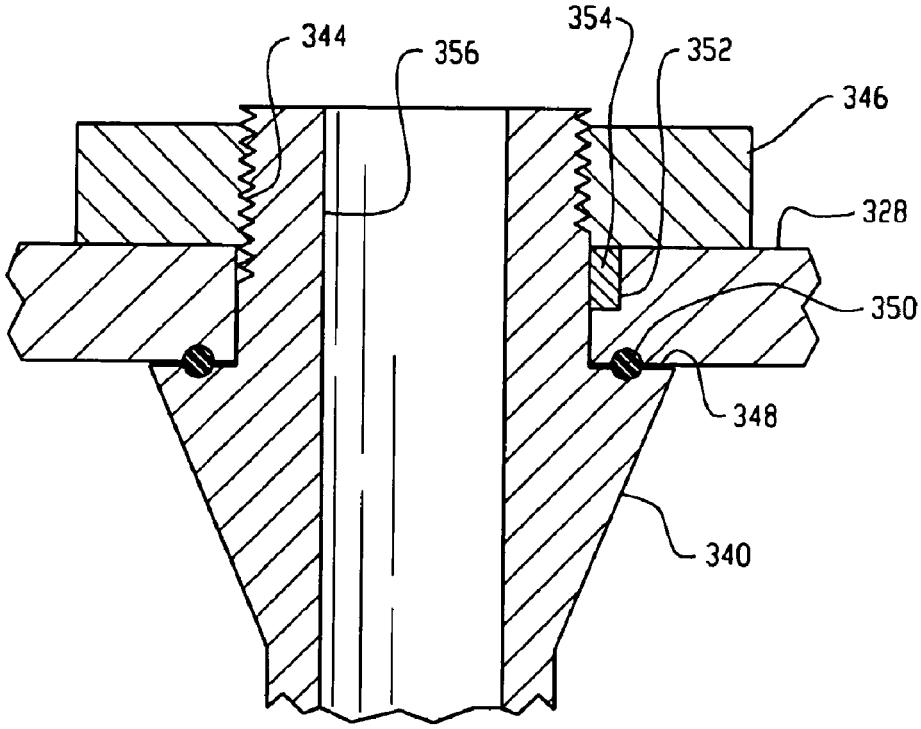
FIG. 18 is an enlarged view of the upper portion of FIG. 17.

An embodiment including internal spray balls for cleaning purposes is shown in FIG. 18. A tank 320 includes an upper neck 322 and flange 324. A bellows assembly 326 extends between the flange 324 and an upper support plate 328. The plate 328 includes one or more holes therein and through which extend one or more hoses 330 with associated spray balls 332 at the ends thereof. Cleaning fluid can be introduced into the interior of the tank, and particularly directed towards the bellows assembly, for cleaning purposes. The upper plate is connected for pivoting movement with shafts 334 and 336. In this embodiment, and as more clearly seen in the enlarged view of FIG. 18, the plate 328 also includes a central opening through which the upper portion 338 of the non-rotating mixing shaft 340 extends. The upper portion 338 includes a tapered section 342 below the plate 328 and a threaded section 344 extending above the plate for being secured by a nut 346. The tapered section 340 includes a stabilizing surface 348 for seating against the underside of the plate 328, and an o-ring 350 may be provided for sealing purposes. The plate 328 may include a keyway 352 and the mixing shaft may include a key 354 for preventing rotation of the shaft. Other arrangements could be provided for preventing rotation of the shaft, and in some cases the locking force of the nut 346 may be sufficient.

FIG. 18 also depicts a shaft having a passage 356 extending therethrough. Embodiments including such a shaft could be provided for introducing material into the tank through the shaft via a connection to the portion of the shaft extending through the plate 328. The passage could extend all the way to the attached impeller for introducing materials at the point of mixing, could include one or more openings along the length of the shaft for introducing materials at any of various levels in the tank, or could include both. Any of the previously described mixing arrangements could likewise include such a shaft with a passage therethrough.

Although the invention has been described above in detail referencing certain embodiments thereof, it is recognized that various changes and modifications could be made, including both broadening and narrowing variations of the appended claims.

What is claimed is:

1. A mixing arrangement for a closed-tank mixing system including a tank defined by a side wall, a bottom and a top, the top including at least one opening therethrough, the arrangement comprising:

a non-rotating elongated arm extending through the opening in the top of the tank, the arm pivoted for movement about a pivot axis;

an impeller positioned on the arm for movement therewith and within the tank, the impeller moving back and forth along an arcuate path within the tank as the arm pivots back and forth about the pivot axis, wherein the impeller is configured to produce a net circular flow within the tank about an axis normal to the opening in the top of the tank when the impeller is moved back and forth alone the arcuate path; and a flexible seal arrangement exterior of the opening and positioned about the arm and including a flexible seal having a first continuous edge held between spaced apart support surfaces and a second continuous edge held between spaced apart support surfaces, the flexible seal arrangement enclosing contents within the tank.

2. The mixing arrangement of claim 1 further comprising:

a support plate positioned over the top of the tank and exterior of the opening, the arm rigidly connected to the support plate for movement therewith, movement of the support plate causing pivot of the arm about the pivot axis.

3. The mixing arrangement of claim 1 wherein the first continuous edge is a radially outer edge and the second continuous edge is a radially inner edge.

4. The mixing arrangement of claim 3 wherein one of the spaced apart supports holding the radially outer edge is a first support ring and wherein one of the spaced apart supports holding the radially inner edge is a second support ring.

5. The mixing arrangement of claim 3 wherein the opening of the tank is defined by an annular member spaced from the arm and forming one of the spaced apart supports holding the the radially outer edge of the flexible seal.

6. The mixing arrangement of claim 1 wherein the flexible seal comprises a bellows member.

7. The mixing arrangement of claim 1 wherein the flexible seal is formed of one of a polytetrafluoroethylene (PTFE), a fluoroelastomer material, a perfluoroelastomer material, or a stainless steel material.

8. The mixing arrangement of claim 1 wherein the impeller includes first and second diametrically opposed blades, the first blade including a generally concave portion at a first side and a generally convex portion at a second side, the second blade including a generally concave portion at a first side and a generally convex portion at a second side, the first side of the first blade facing toward one side of the arcuate path and the first side of the other blade facing toward an opposite side of the arcuate path.

9. The mixing arrangement of claim 1 further comprising means for pivoting the arm about the pivot axis.

10. The mixing arrangement of claim 1 wherein the pivot axis is defined by at least one support shaft positioned above the tank, a support connected with the shaft for pivoting about the pivot axis, the elongated arm rigidly mounted to the support for movement therewith, a motor connected to the support via a linkage system for rotating the support back and forth.

11. The mixing arrangement of claim 1 wherein the pivot axis is defined by at least one support shaft extending at a point outside the tank and positioned below the opening in the tank, the shaft connected to a support positioned above the tank opening, the elongated arm member extending from the support, the pivot axis located at an intermediate point along the arm member and below the top opening of the tank.

12. The mixing arrangement of claim 1 wherein the tank, arm and impeller are glass lined.

13. The mixing arrangement of claim 1 wherein the arm is comprised of a straight shaft.

14. The mixing arrangement of claim 1 wherein the pivot axis is defined by at least one support shaft extending at a point outside the tank, the shaft offset from and connected to a support positioned adjacent the tank opening, the elongated arm member extending from the support, the pivot axis located at an intermediate point along the arm member and within the tank.

15. The mixing arrangement of claim 1 wherein the first continuous edge is held in a substantially horizontal plane and the second continuous edge is held in a substantially horizontal plane.

16. A mixing arrangement for a closed-tank mixing system including a tank defined by a side wall, a bottom and a top, the tank including at least one opening therethrough, the arrangement comprising:

a non-rotating elongated arm extending through the opening in the tank, the arm pivoted for movement about a pivot axis;

an impeller positioned on the arm for movement therewith and within the tank, the impeller moving back and forth along an arcuate path within the tank as the arm pivots back and forth about the pivot axis, wherein the impeller is configured to interact with material in the tank so as to produce a net circular flow of material within the tank when the impeller is moved back and forth along the arcuate path; and a flexible seal arrangement enclosing material in the tank to provide a sealed tank system.

17. The mixing arrangement of claim 16 wherein the opening in the tank is positioned in the side wall of the tank.

18. The mixing arrangement of claim 17 further comprising:

a support pivotably mounted aside the opening and exterior of the tank, the arm rigidly connected to the support for movement therewith, movement of the support causing pivot of the arm about the pivot axis.

19. The mixing arrangement of claim 16 wherein the flexible seal arrangement includes a flexible membrane surrounding a portion of the elongated arm.

20. The mixing arrangement of claim 16 wherein the impeller includes first and second diametrically opposed blades, the first blade including a generally concave portion at a first side and a generally convex portion at a second side, the second blade including a generally concave portion at a first side and a generally convex portion at a second side, the first side of the first blade facing toward one side of the arcuate path and the first side of the other blade facing toward an opposite side of the arcuate path.

21. The mixing arrangement of claim 16 wherein movement of the impeller along the arcuate path also produces a top to bottom flow with the tank.

22. The mixing arrangement of claim 16 wherein the pivot axis is defined by at least one support shaft positioned outside the tank, a support connected with the shaft for pivoting about the pivot axis, the elongated arm rigidly mounted to the support for movement therewith, a motor connected to the support via a linkage system for rotating the movement therewith, a motor connected to the support via a linkage system for rotating the support back and forth about the shaft.

23. The mixing arrangement of claim 16 further comprising:

a support plate positioned exterior of the tank opening, the arm extends from the support plate for movement therewith, movement of the support plate causing pivot of the arm about the pivot axis.

24. A mixing arrangement comprising:

a tank having a side wall, a bottom and a top, the top including at least one opening therethrough, the tank including a pharmaceutical composition therein to be mixed:

a non-rotating elongated arm extending through the opening in the top of the tank, the arm extending into the pharmaceutical composition and pivoted for movement about a pivot axis;

an impeller positioned on the arm for movement therewith and within the pharmaceutical composition in the tank, the impeller moving back and forth along an arcuate path within the tank as the arm pivots back and forth about the pivot axis; and wherein the impeller is configured to interact with the pharmaceutical composition and create a net circular flow of pharmaceutical composition within the tank.

25. The mixing arrangement of claim 24 wherein the impeller includes first and second diametrically opposed blades, the first blade including a generally concave portion at a first side and a generally convex portion at a second side, the second blade including a generally concave portion at a first side and a generally convex portion at a second side, the first side of the first blade facing toward one side of the arcuate path and the first side of the other blade facing toward an opposite side of the arcuate path.

26. The mixing arrangement of claim 24 wherein the tank includes at least one inlet and at least one outlet.

27. The mixing arrangement of claim 24 wherein the elongated arm includes a fluid passage therethrough for introducing fluid into the tank.

28. The mixing arrangement of claim 24 wherein an exterior end of the arm connects to a support and a portion of the arm extends through the support.

29. The mixing arrangement of claim 24 wherein the tank is sealed and at least one spray ball device extends within the tank.

30. The mixing arrangement of claim 24 wherein the side wall is substantially cylindrical.

31. The mixing arrangement of claim 30, further comprising:

a flexible seal arrangement enclosing material in the tank to provide a sealed mixing system.

32. The mixing arrangement of claim 24 further comprising:

a support plate positioned exterior of the tank opening, the arm extends from the support plate for movement therewith, movement of the support plate causing pivot of the arm about the pivot axis.

33. A mixing method for a tank system, the method comprising:

providing a tank with a substantially cylindrical sidewall and a material to be mixed within the tank;

providing a non-rotating elongated arm extending within the tank through a tank opening;

providing an impeller on the elongated arm and within the tank and below a level of the material to be mixed;

moving the elongated arm back and forth to move the impeller back and forth through an arcuate path within the tank to generate a net circular flow of material within the tank.

34. The method of claim 33, further comprising:

providing a sealing arrangement about the tank opening and a portion of the elongated arm to fully enclose contents within the tank.

35. The method of claim 33 wherein a location of the arcuate path within the tank is fixed relative to the tank.

36. A method for mixing pharmaceutical compositions in a closed tank system, the method comprising:

providing a pharmaceutical composition within a tank;

providing a non-rotating elongated arm extending within the tank through a tank opening;

providing an impeller on the elongated arm and within the tank and below a level of the pharmaceutical composition;

providing a sealing arrangement about the tank opening and elongated arm;

pivoting the elongated arm back and forth about a pivot to move the impeller back and forth through an arcuate path within the tank.

37. The method of claim 36 wherein movement of the impeller back and forth along the arcuate path creates a net circular flow of the pharmaceutical composition within the tank.

* * * * *

UNITED STATES PATENT AND TRADEMARK OFFICE

CERTIFICATE OF CORRECTION

PATENT NO. : 6,883,960 B2
DATED : April 26, 2005
INVENTOR(S) : Mark F. Reeder et al.

It is certified that error appears in the above-identified patent and that said Letters Patent is hereby corrected as shown below:

Column 9,
Line 2, change “alone” to -- along --.

Column 10,
Lines 54 and 55, delete duplicate language “movement therewith, a motor connected to the support via a linkage system for rotating the”.

Signed and Sealed this

Fifth Day of July, 2005

JON W. DUDAS
*Director of the United States Patent and Trademark Office*